US007934465B1

(12) United States Patent
Brinker

(10) Patent No.: US 7,934,465 B1
(45) Date of Patent: May 3, 2011

(54) ADHESIVE APPLICATOR HEAD

(75) Inventor: Timothy J. Brinker, Hillsboro, OH (US)

(73) Assignee: Henline Adhesive Equipment Co., Inc., Loveland, OH (US)

( * ) Notice: Subject to any disclaimer, the term of this patent is extended or adjusted under 35 U.S.C. 154(b) by 837 days.

(21) Appl. No.: 11/982,962

(22) Filed: Nov. 6, 2007

Related U.S. Application Data

(60) Provisional application No. 60/856,904, filed on Nov. 6, 2006.

(51) Int. Cl.
*B05C 5/02* (2006.01)

(52) U.S. Cl. ..... 118/302; 118/313; 118/315; 156/578; 222/330; 239/418; 239/423; 239/290; 239/291

(58) Field of Classification Search ..... 118/300, 118/313, 315; 156/291, 295, 324, 578; 222/145.6, 222/146.1, 146.5, 130, 330; 239/547, 550, 239/566, 418, 423, 290, 291
See application file for complete search history.

(56) References Cited

U.S. PATENT DOCUMENTS 5,238,190 A * 8/1993 Herke ..... 239/298
5,382,312 A 1/1995 Raterman
5,421,941 A * 6/1995 Allen et al. ..... 156/244.11
6,149,076 A * 11/2000 Riney ..... 239/135
6,540,831 B1 * 4/2003 Craine et al. ..... 118/314
6,719,846 B2 * 4/2004 Nakamura et al. ..... 118/313
6,899,288 B2 * 5/2005 Filicicchia et al. ..... 239/424
2002/0092865 A1 * 7/2002 Takagi et al. ..... 222/94

* cited by examiner

*Primary Examiner* — Laura Edwards
(74) *Attorney, Agent, or Firm* — Charles R. Wilson

(57) ABSTRACT

As adhesive applicator head for use on an assembly line apparatus dispenses adhesive in a non-contact manner to produce a wide band of adhesive on a moving substrate. The applicator head comprises an upper body secured to a lower body and at least one nozzle mounted therewithin. An adhesive manifold within the applicator head ensures a steady flow of adhesive to tips of the nozzles. An air manifold within the applicator head is in communication with opposed pin holes positioned alongside each nozzle and oriented so that high velocity air exits the pin holes and flows along a nozzle tip of the nozzle. The high velocity air encounters freshly dispensed adhesive at the nozzle tip and causes it to leave the tip in a back-forth manner to result in a scribble pattern on the substrate. The scribble pattern's width is well defined. It is determined primarily by side to side placement of the nozzles in the applicator head at about the adhesive band width desired.

14 Claims, 5 Drawing Sheets

ADHESIVE APPLICATOR HEAD

This application claims the benefit of U.S. Provisional Application No. 60/856,904, filed Nov. 6, 2006.

FIELD OF INVENTION

This invention relates to an adhesive applicator head. More particularly, the invention relates to an adhesive applicator head which dispenses adhesive in a non-contact manner to form a wide band of adhesive on a moving substrate.

BACKGROUND OF INVENTION

Assembly lines where adhesive is applied to an advancing line of cardboard, paper, thin plastic blanks, or the like are very commonplace. The adhesive is dispensed from an automated applicator head. The blanks are subsequently manipulated to create a container or other manufactured article.

In some applications, a wide band of adhesive needs to be applied to the moving substrate. Known processes for this purpose utilize extruding, spraying, roll coating and swirling techniques. All such processes have their advantages and disadvantages as explained below.

The extruding process forces the adhesive, under pressure, onto the substrate. A nozzle selected for a desired adhesive band width or thickness is chosen according to need. The process usually is done with the nozzle contacting the substrate. This tends to concentrate the adhesive deposit, which limits its spreadability. It also causes wear to the nozzle and can lead to frequent cleaning of its tip and associated apparatus. Most importantly, the volume of adhesive applied by the contact extrusion process is very difficult to control, resulting in over/under adhesive applied products. This, in turn, results in lack of cost control and quality control.

In the spraying process, there is no contact with the substrate as the adhesive is sprayed onto it through a nozzle. But the adhesive is very fast drying due to air atomization and, therefore, has less open time. Also, air atomization can cause a mess on the equipment itself and wastes material due to airborne misting of small adhesive particles. The pattern width of applied adhesive will vary with the nozzle height over the substrate. Adjusting the height gives the user a certain degree of band control, but it increases machine setup time.

The roll coating process contacts the substrate with a coated roll. By the very nature of the process, the adhesive needs to be applied in a thin layer. This increases the adhesive surface to air ratio which in turn speeds the curing process. The precision design of the machine makes it relatively expensive and is less adaptive to selecting various adhesive band widths. Also, adhesive is wasted and much clean-up is required.

In the swirling process, a dispensing valve does not contact the substrate. Rather, it produces a tight circular pattern. This pattern produces uneven dispensing as it produces heavy pattern lines on the outside dimension of the swirl in the direction of the automated product or applicator movement. The swirling process can also lead to an uneven start/stop pattern.

Effectively applying an adhesive in the needed wide pattern manner has been accomplished, but not without inherent problems as noted. There has now been developed an adhesive applicator head which applies a wide band of adhesive to a moving substrate without substrate contact and its inherent problems. The width of the adhesive band is readily controlled. Most importantly, the applicator head of the invention is self-sealing during line stoppage and self-cleaning after a prolonged line stoppage.

SUMMARY OF INVENTION

The adhesive applicator head of the invention comprises an upper block and a lower block secured together. It further includes at least one air bathed adhesive nozzle mounted within the secured upper and lower blocks. The upper block has a first inlet port for liquid adhesive, an adhesive manifold in communication with the inlet port and at least one step drilled vertically disposed hole leading from the adhesive manifold to an underside of the upper block. The upper block further has a second inlet port for air with a passageway leading to a cavity in the block's underside. The lower block forms an air manifold with the cavity in the upper block's underside. A vertically disposed hole in the lower block is in alignment with each step-drilled vertically disposed hole of the upper block. Opposing pin holes extend along each vertically disposed hole in the lower block. A nozzle is mounted in each aligned two sets of holes. Adhesive from the adhesive manifold is forced to a tip of each nozzle. At the same time, air from the air manifold is directed through the pin holes and along the associated nozzle tip to cause the adhesive to leave an orifice at the nozzle tip in a back and forth manner. A scribble pattern of adhesive is formed on a moving underlying substrate in a well defined wide band.

DETAILED DESCRIPTION OF INVENTION

The adhesive applicator head of the invention is used on commonly used adhesive apparatuses. It is used to apply liquid adhesives of all natures onto a moving substrate such as webs and blanks. The liquid adhesives include, without limitation, water based, organic solvent based, liquified 100% solid based, and 100% solids liquid based adhesives. It is particularly useful in applying a cold heavy bodied liquid adhesive to cardboard blanks which are subsequently assembled into containers.

Figure 1:
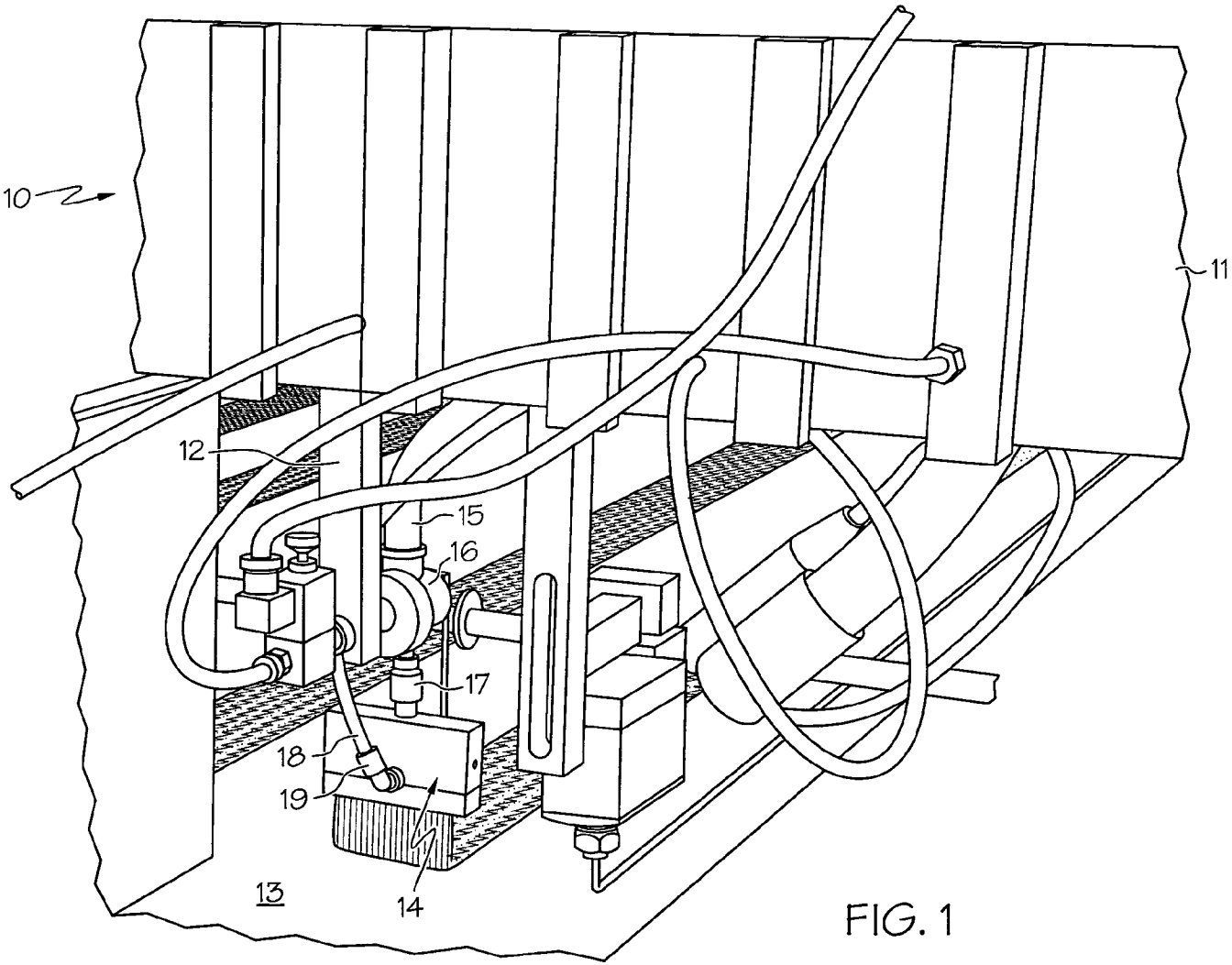
FIG. 1 is an environmental view of an adhesive apparatus used in a high speed assembly line utilizing an adhesive applicator head of the invention.

With reference to FIG. 1, there is shown a partial view of an apparatus 10 designed to supply multiple wide bands of adhesive to one or more moving substrates. The apparatus 10 includes a frame 11, support brackets 12, and a conveyor (not shown) to move a substrate web 13. Positioned above the substrate web 13 and mounted on support brackets 12 are multiple adhesive applicator heads of the invention. One multi-ported applicator head 14 is apparent in FIG. 1. Adhesive from a source (not shown) is fed through tubing 15 to an adhesive valve 16 and then through an adhesive inlet fitting 17 to the applicator head 14. A single source of adhesive is used to feed the multiple applicator heads through the tubings. Still other tubing 18 leads from a compressed air source (not shown) to deliver low pressure air to an air inlet fitting 19 of each applicator head 14. A wide band of adhesive deposited onto the substrate web 13 in a scribble pattern is evident.

The height of the applicator head above the substrate is not critical to achieving a defined pattern width of adhesive on the substrate. This is to be contrasted with known adhesive applicator processes such as a spray process where adhesive forced from one or more nozzles will form on the substrate in an ill defined band width. The particular width of the spray applied adhesive is very dependent on the distance between the applicator head and the substrate.

Figure 2:
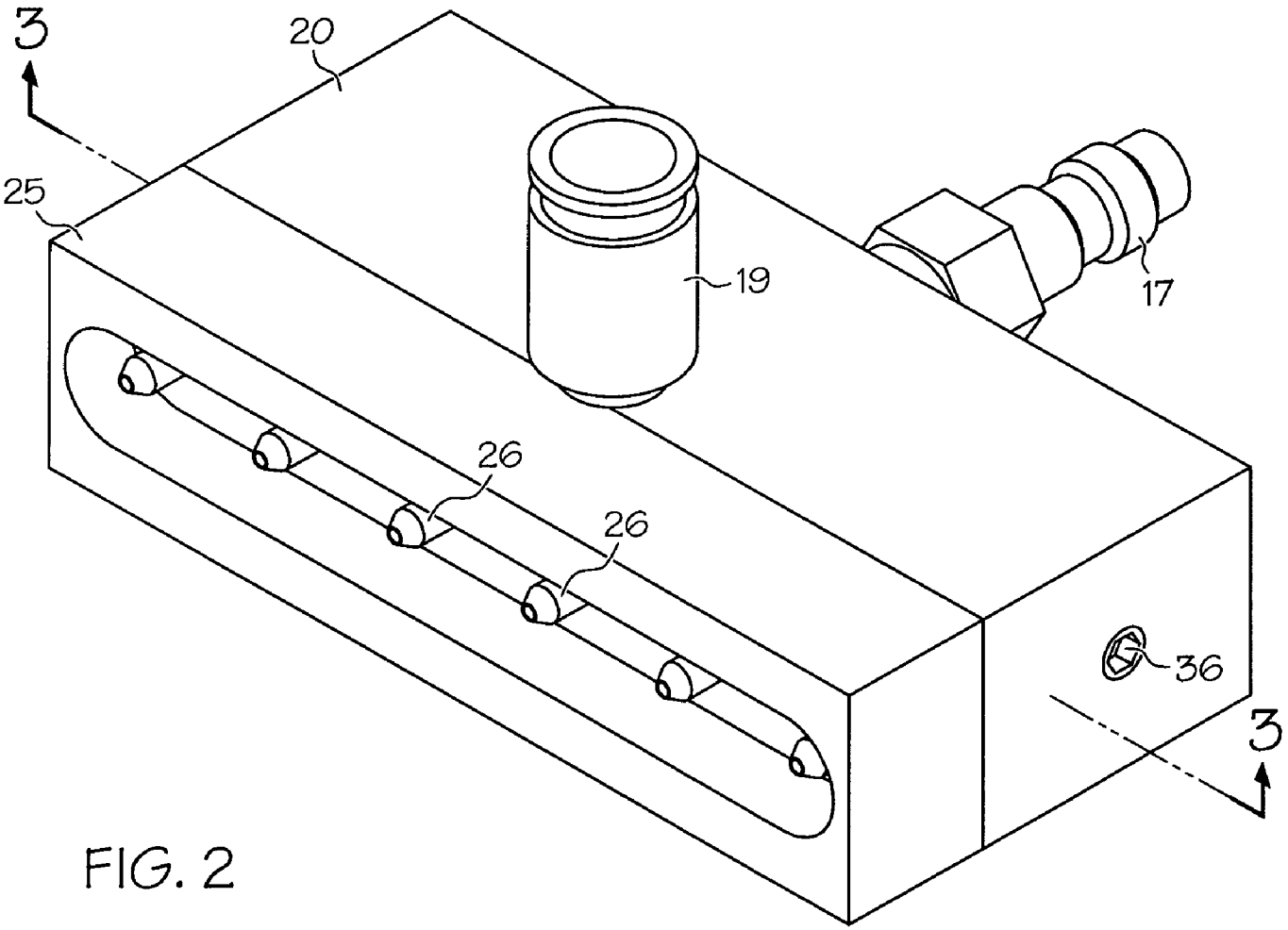
FIG. 2 is a view in perspective of the adhesive applicator head of the adhesive apparatus of FIG. 1 in isolation.
Figure 3:
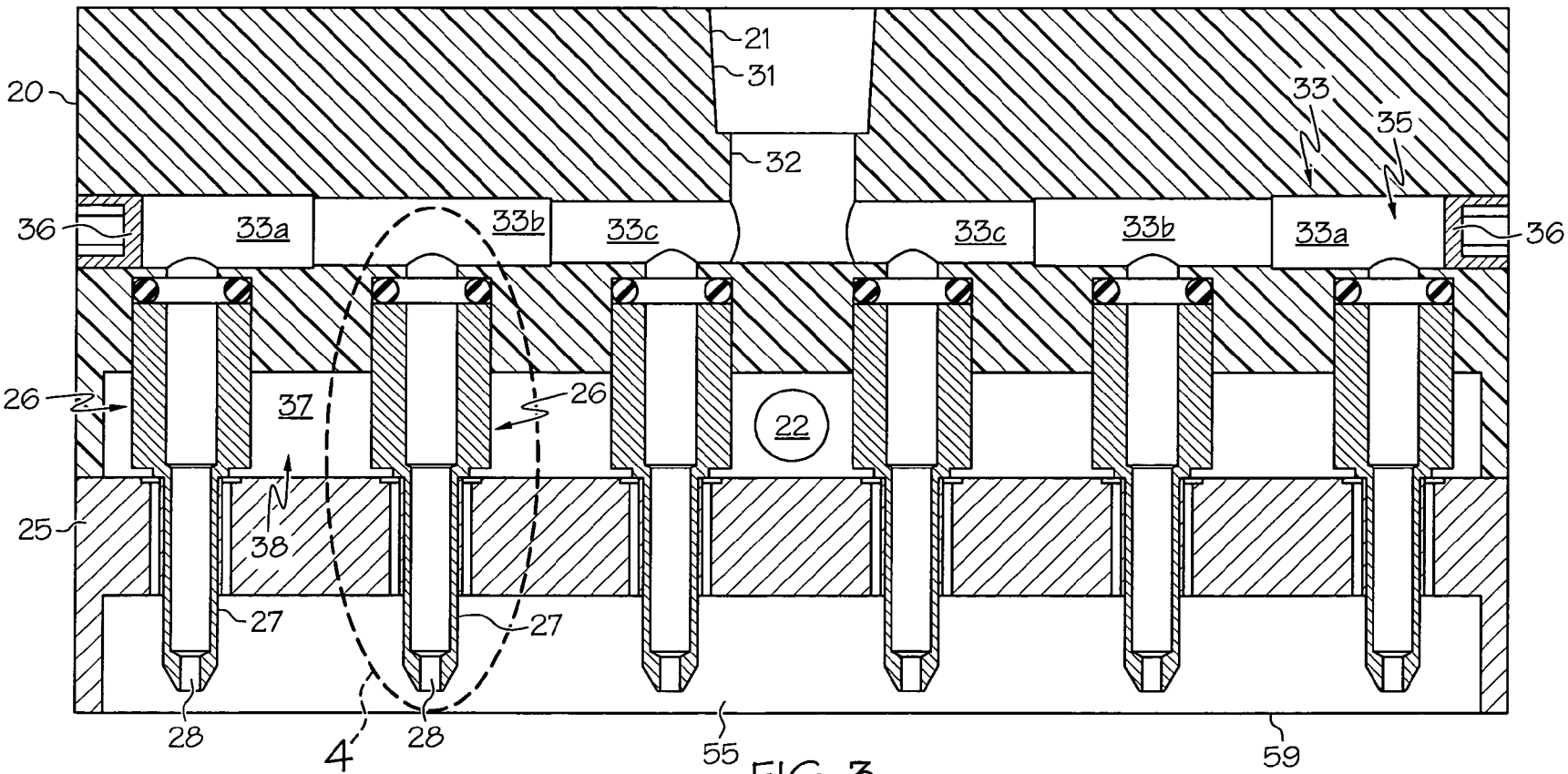
FIG. 3 is a front elevational view in section along line 3-3 of the adhesive applicator head of FIG. 2.

Now with reference to FIGS. 2 and 3, the applicator head 14 of the invention comprises an upper block 20 having a first inlet port 21 and a second inlet port 22 (said inlet ports best seen in FIG. 3). The upper block 20 is secured to a lower block 25. A set of nozzles 26 is mounted in the upper and lower blocks. As best seen in FIG. 3, each nozzle has a nozzle tip 27 with an orifice 28. The nozzle tips extend at least partially through an underside of the lower block 25.

Figure 5:
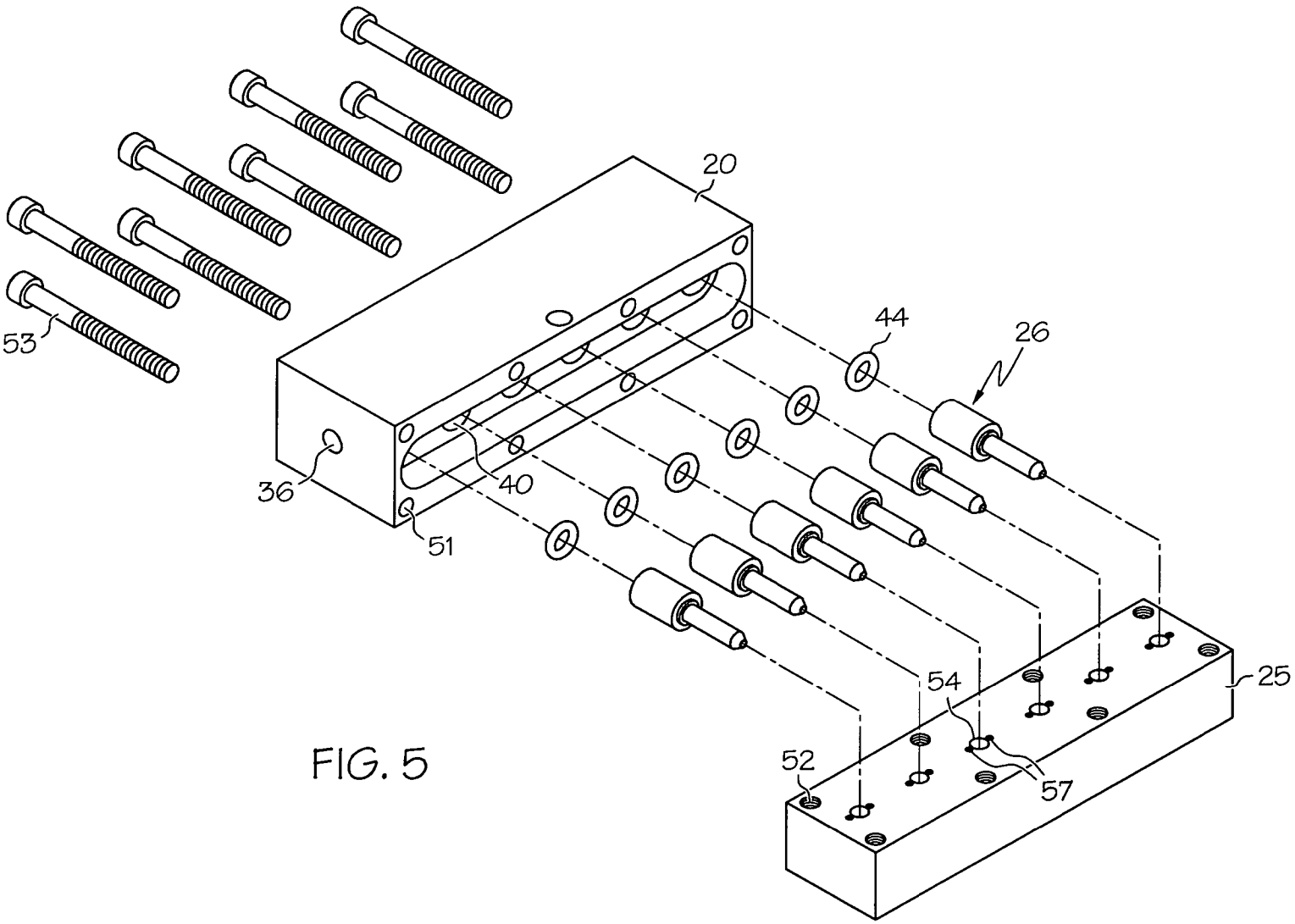
FIG. 5 is an exploded view of the adhesive applicator head of FIG. 2.

More particularly, and now with reference to FIGS. 3 and 5, the upper block 20 is box-shaped. As best seen in FIG. 3, its first inlet port 21 is an approximately centered hole extending substantially vertically and partially into the upper block 20. Preferably it is a two stepped drilled hole. The hole's ingress 31 is threaded to receive the adhesive inlet fitting 17 and its more narrow egress 32 serves as a passageway for adhesive.

The upper block further has a hole 33 step drilled horizontally across the upper block 20 so as to intersect the egress 32 of the first inlet port 21 at an approximate right angle. The hole 33 has three chambers 33*a*, 33*b*, and 33*c* of decreasing diameters extending from each side laterally inwardly to the approximate center where it meets the first inlet port's egress 32. Collectively, the chambers form an adhesive manifold 35. Both ends of the hole are internally threaded to receive externally threaded plugs 36. The adhesive manifold 35 is for receiving and holding adhesive which is initially pumped through the inlet fitting 17, prior to being forced into the nozzles 26 as discussed in detail below.

The upper block 20 has a cavity 37 formed in its underside which serves in conjunction with the lower body's upper surface as an air manifold. The cavity 37 is approximately centered and extends substantially across the upper body's underside.

Figure 4:
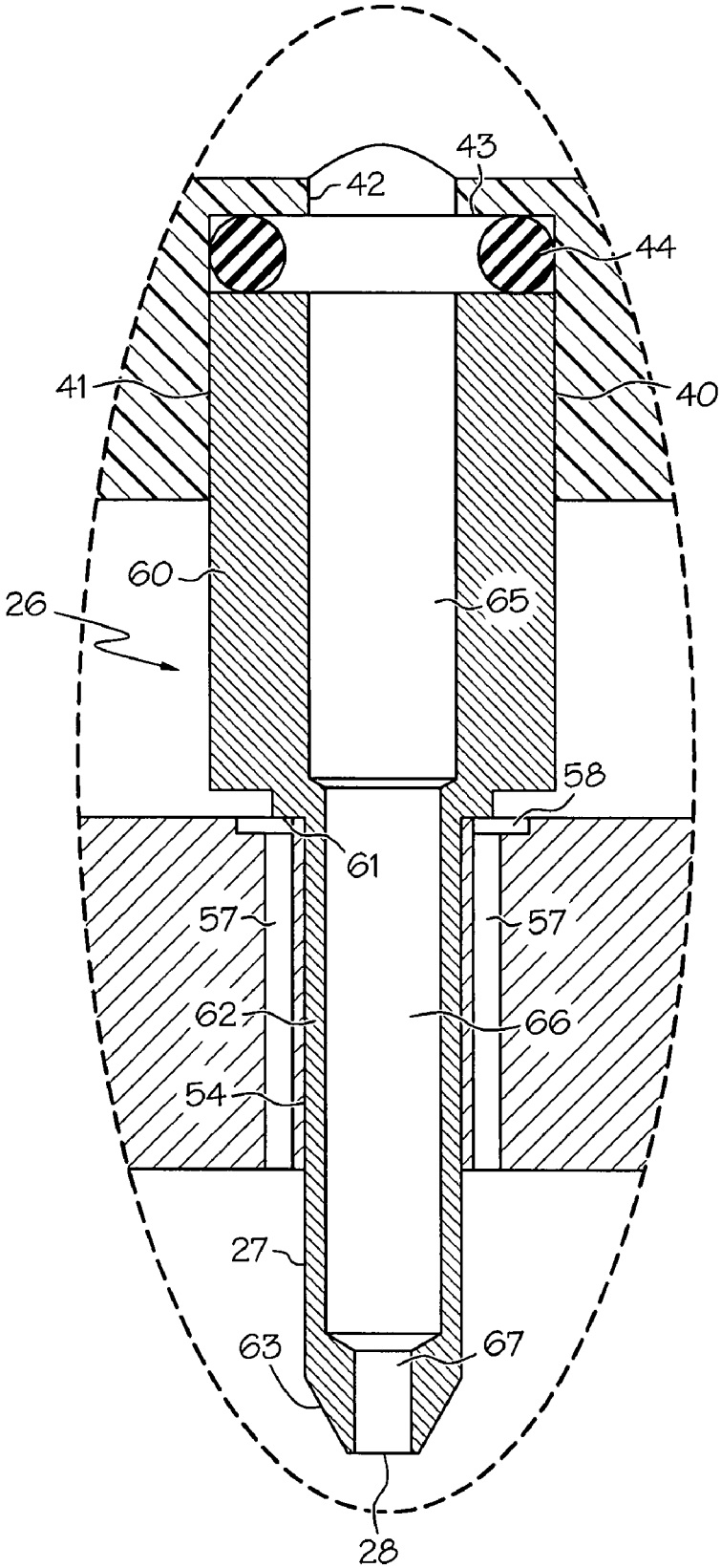
FIG. 4 is a view in isolation along line 4 of FIG. 3 showing a nozzle of the adhesive applicator head.

Still with reference to FIGS. 3 and 5, the upper block 20 also has a set of substantially equi-spaced step drilled vertically disposed holes 40 positioned laterally thereacross and leading from the adhesive manifold 35 to the cavity 37. As best seen in FIG. 4, a lower portion 41 of each hole 40 has a greater diameter than an upper portion 42. A shoulder 43 is created at a plane where the upper and lower portions to serve as a seat for an O-ring 44. The hole 40 is configured to slidably receive one of the nozzles and allow its top to extend to the O-ring 44 so as to be in communication with the adhesive manifold 35.

As evident in FIGS. 2, 3, and 5, the upper and lower blocks of the adhesive applicator head have a width sufficient to accommodate six nozzles. A lesser or greater number of nozzles can be used. A single nozzle is feasible. Preferably, the adhesive applicator head of the invention has from two to twelve nozzles which are substantially equi-spaced to form a wide band of adhesive up to about three inches in width during operation, preferably from about one-half inch to about three inches in width.

The upper block 20 as above mentioned includes the air cavity 37 in its underside. The second inlet port 22 with its threaded air inlet fitting 19 is used to convey low pressure air to the cavity 37, which acts as an air manifold 38 when the upper and lower blocks are secured together. The air manifold 38 fed by a single inlet port facilitates free movement of air across the manifold, thus resulting in even airflow across all the nozzles.

For securing purposes and as seen in FIG. 5, screw holes 51 extending around the periphery of the upper block 20 extend substantially vertically therethrough. An aligned set of internally threaded screw holes 52 are provided in the lower block 25. The screws 53 are simply inserted into and fully through the screw holes 51 of the upper block 20 and then into the aligned threaded screw holes 52 of the lower block 25. They are finally tightened for the secure fit.

Again with reference to FIGS. 2-5, the lower block 25 is box-shaped with a substantially flat upper surface to sealingly contact the lower surface of the upper block 20 and form a substantially air tight air manifold. It further has a set of vertically disposed holes 54 which are aligned with the vertically disposed holes 40 in the upper block 20 and extend fully through the lower block 25 from its upper surface to a nozzle tip cavity 55. The two sets of vertically disposed aligned holes 40 and 54 are configured to receive the nozzles 26, described in detail below. Still further, the lower block has opposed pin holes 57 associated with each vertically disposed hole 54. The pin holes extend from the air manifold to the lower block's nozzle tip cavity 55. They run substantially in-line to the vertically disposed holes 40 and within about seven mils thereof. As evident in FIG. 4, shallow depression 58 in the lower block's upper surface surrounds each pin hole's ingress to ensure the air reaches the pin holes for travel therethrough. Air forced through the pin holes reach the tip of a nozzle positioned in the hole.

The nozzle tip cavity 55 is provided in the underside of the lower block. It is sufficiently deep to allow at least about 250 mils of free nozzle tip exposure while not allowing any nozzle tip to extend past a plane extending across the lower block's undersurface 59. This lessens inadvertent damage to the nozzle tips.

Each nozzle 26 as best seen in FIGS. 3 and 4 has a cylindrical-shaped body 60, a shoulder 61 of lesser diameter, and a still lesser diameter long narrow cylindrical-shaped nozzle tip 62 with a truncated conical-shaped terminus 63. Adhesive from the adhesive manifold 35 is forced into a passageway 65 in the body 60, into a narrowed passageway 66 in the nozzle tip 62 and into a still more narrow passageway 67 in the terminus 63. The continually narrowing passageways ensure that a constant flow of adhesive exits the orifice 28 of the nozzle 26 during operation. The shoulder 61 of the nozzle 26 helps direct air flow in accord with the invention. In effect, the shoulder 61 creates a restricted path of air in the air manifold to, in turn, create an even air flow across all the nozzles.

The nozzles 26 are configured to fit into the vertically disposed holes 40 of the upper block 20, the vertically disposing holes 54 of the lower block 25, and extend into the nozzle tip cavity 55 of the lower block 25. The underside of the shoulder 61 of each nozzle 26 rests on the upperside of the lower block 25 and ensures that air is able to reach the shallow depression 58 and then enter the two pin holes associated with each vertically disposed hole 54.

When adhesive is being dispensed by the applicator head 14, air is forced into the air manifold of the applicator head. The air is under pressure and is further forced through the pin holes associated with each nozzle. The low pressure air entering the pin holes exits as high velocity streams of air about mid-way along the narrow nozzle tips 62. At least about 200 mils of the narrow nozzle tip is contacted by the air streams. The streams of air continue down the narrow nozzle tips 62 creating boundary layer type airflow around the narrow nozzle tip. In turn, a hugging effect is produced around the truncated conical-shaped terminus thereby creating a venturi action across the terminus to gently move the adhesive side to side as it leaves the nozzle tip's orifice. This side to side adhesive movement as the adhesive is forced from the terminus and free falls to the moving substrate creates the scribble pattern of adhesive on the substrate. No significant amount of adhesive atomization occurs. Each of the six nozzles 26 depicted in the drawings is responsible for the scribble pattern adhesive on the substrate which extend laterally across the substrate.

In operation, adhesive is supplied to the adhesive inlet fitting of the applicator head of the invention in a conventional way. Air is then supplied under low pressure from a compressed air source to the air inlet fitting of the applicator head. The adhesive is forced into the adhesive manifold until its capacity is reached, at which time the adhesive is forced into the passageways of each nozzle's cylindrical-shaped body and cylindrical-shaped narrow tip. At the same time, air from the air inlet fitting fills the air manifold under pressure slightly above atmospheric pressure. It then is forced into each set of pin holes of the lower block. The air exits the pin holes alongside the nozzle tips where it travels along the narrow nozzle tips until it encounters the adhesive exiting at the orifice of each nozzle terminus. Adhesive is forced to move in a back and forth manner by the air as it falls from the terminuses and onto a moving web directly below the applicator head.

The adhesive from the multi nozzle applicator head above described falls on the moving substrate in a scribble pattern with a width slightly wider than the width of the nozzles positioned in the applicator head. The adhesive band width is consistent throughout a run. The result is a well defined wide band scribble pattern of the adhesive on the substrate. The adhesive is evenly dispersed and appears on the substrate in generally elongated globules. There is minimal fiberisation on the substrate.

A further benefit enjoyed by use of the applicator head of the invention is its ability to self clean and seal itself. This is accomplished in a tip sealing cycle with a cleaning solvent, e.g. water or other appropriate solvent depending on the adhesive used. The normal air manifold input port is used to inject a small amount of the cleaning solvent, e.g. about 0.1 cc, into an intermittent air blast when the adhesive dispensing is idled for whatever reason. A water blast is created which is evenly distributed through turbulence created in the air manifold chamber. The water blast is further atomized by the high velocity created as the air/water mixture exits the air orifices along the sides of the nozzle. Since adhesive is not being dispensed, the venturi action takes precedence and water vapor is drawn into the orifices of the nozzle tips, progressively diluting the adhesive in each nozzle tip until the nozzles are mostly filled with water (1-3 hours). At this point, further water injections are abated since the water filled nozzles create a long lasting clean seal.

The tip sealing cycle of the applicator is designed to automatically dispense by activating a recycle time delay relay when adhesive is not being dispensed. The water or other appropriate solvent is injected into the air stream through a check valve and a small orifice under extremely low pressure.

Start up after long periods of inactivity will require a short blast of adhesive to flush out the water and diluted adhesive in the applicator. For short periods of inactivity, very little water is drawn into the tip of the nozzle and the integrity of the adhesive is minimally affected allowing the user to restart dispensing without even the short adhesive blast purging. In either case, a clean sealed tip is maintained, which is a prerequisite for accurate low pressure adhesive dispensing.

The intermittent operation of the cleaning design is important to the success of the operation since a continual air/water flow will create a flow directional path in the adhesive manifold. This results in excessive water being pulled into one side of the manifold and adhesive extruded through the opposite side of the manifold. The intermittent high forced air/water blast maximizes cleaning and sealing while it reduces air and water consumption. There is no need to cap or clean the nozzles during intermittent down times.

Higher air pressures during the adhesive dispensing create a pressure differential that seals the check valve in the water dispense tube. This prevents back pressure into the water dispensing equipment and shuts off water flow to the air stream. Only in the sealing mode, i.e. the off cycle, will the pressure differential be reversed. Water is then allowed into the line until the on cycle of the recycled time delay relay kicks in and the water enters the applicator head as stated above.

Having described the invention in its preferred embodiment, it should be clear that modifications can be made without departing from the spirit of the invention. Further, the adhesive applicator head can be used for dispensing materials other than adhesive. It is not intended that the words used to describe the invention nor the drawings illustrating the same be limiting on the invention. It is intended that the invention only be limited by the scope of the appended claims.

I claim:

1. An adhesive applicator head for applying a wide band of liquid adhesive to a moving substrate, said adhesive applicator head comprising:

(a) an upper block having (i) a first inlet port for liquid adhesive, (ii) an adhesive manifold in communication with the first inlet port for receiving and holding liquid adhesive under low pressure, (iii) at least one vertically disposed step drilled hole leading from the adhesive manifold to an underside of the upper block, (iv) an O-ring positioned in the step drilled hole, (v) a second inlet port for low pressure air, and (vi) a cavity in the underside of the upper block for receiving the low pressure air from the second inlet port;

(b) a lower block secured to the upper block, said lower block having (i) a substantially flat upperside for covering the cavity in the underside of the upper block thereby forming an air manifold for holding the low pressure air received from the second inlet port in the upper block, (ii) a vertically disposed hole aligned with the vertically disposed step drilled hole in the upper block, (iii) two opposed pin holes extending along the length of the vertically disposed hole in the lower block for receiving the low pressurized air from the air manifold and directing the low pressurized air to flow along the air nozzle tip at a high velocity, and (iv) a nozzle tip cavity in an underside of the lower block; and (c) a nozzle with a nozzle tip mounted in the vertically disposed hole of the lower block with an upper end of the nozzle extending into the step drilled hole in the upper block and a lower end of the nozzle extending into the nozzle tip cavity for receiving the liquid adhesive from the adhesive manifold of the upper block and dispensing adhesive therefrom, whereby adhesive forced from the nozzle tip encounters the high velocity air flowing from an associated two pin holes to cause the adhesive to fall from the nozzle tip in a back-forth manner onto the moving substrate to form a wide band of adhesive on the substrate.

2. The adhesive applicator head of claim 1 wherein the upper block has from two to twelve vertically disposed step drilled holes, the lower block has an equal number of vertically disposed holes aligned with the vertically disposed holes of the upper block and an equal number of nozzles mounted in both sets of said vertically disposed holes.

3. The adhesive applicator head of claim 2 wherein the adhesive manifold comprises at least two chambers of decreasing diameters extending from each side laterally inwardly to the approximate center of the adhesive manifold where it meets the first inlet port for the liquid adhesive.

4. The adhesive applicator head of claim 3 wherein the two opposed pin holes are in-line with the associated vertically disposed hole and further are within about seven mils thereof.

5. The adhesive applicator head of claim 4 wherein each of the nozzles has a cylindrical-shaped body, a shoulder of lesser diameter at a lower base of the cylindrical-shaped body, and a still lesser diameter long narrow cylindrical-shaped nozzle tip, with a truncated conical-shaped terminus.

6. The adhesive applicator head of claim 5 wherein the nozzle tip of each of the nozzles extends into the nozzle tip cavity sufficiently far that at least about 200 mils of the nozzle tip is contacted by air streams from the associated opposed pin holes.

7. The adhesive applicator head of claim 6 wherein the lower block further has a shallow depression in its upper surface surrounding the ingress of each pin hole.

8. The adhesive applicator head of claim 7 wherein an underside of the shoulder of each of the nozzles rests on the upperside of the lower block for ensuring that the low pressure air enters the opposed pin holes.

9. An adhesive applicator head for applying a wide band scribble pattern of liquid adhesive to a moving substrate, said adhesive applicator head comprising:

(a) an upper block having (i) a first inlet port for liquid adhesive, (ii) an adhesive manifold in communication with the inlet port for receiving and holding liquid adhesive under low pressure, (iii) a set of substantially equispaced vertically disposed step drilled holes leading from the adhesive manifold to an underside of the upper block, (iv) an O-ring positioned in each of the step drilled holes, (v) a second inlet port for low pressure air, and (vi) a cavity in the underside of the upper block for receiving the low pressure air from the second inlet port;

(b) a lower block secured to the upper block, said lower block having (i) a substantially flat upperside for covering the cavity in the underside of the upper block thereby forming an air manifold for holding the low pressure air received from the second inlet port in the upper block, (ii) a set of vertically disposed holes aligned with the vertically disposed step drilled holes in the upper block, (iii) two opposed pin holes extending in-line along the length of each of the vertically disposed holes of the lower block for receiving the low pressurized air from the air manifold and directing the low pressurized air to flow along the air nozzle tip at a high velocity, (iv) a shallow depression surrounding an ingress of each of the opposed pin holes, and (v) a nozzle tip cavity in an underside of the lower block; and (c) a set of nozzles with nozzle tips, each of the nozzles mounted in one of the vertically disposed holes of the upper and lower blocks with an upper end of each of the nozzles extending into one of the step drilled holes in the upper block and a lower end of each of the nozzles extending into the nozzle tip cavity for receiving the liquid adhesive from the adhesive manifold of the upper block and dispensing adhesive therefrom, whereby adhesive forced from the nozzle tip of each of the nozzles encounters the high velocity air flowing from an associated two pin holes to cause the adhesive to fall from the nozzle tip in a back-forth manner onto the moving substrate to form a wide band of adhesive in the scribble pattern on the substrate.

10. The adhesive applicator head of claim 9 wherein the upper block has from two to twelve vertically disposed step drilled holes, the lower block has an equal number of vertically disposed holes aligned the vertically disposed holes of the upper block and an equal number of nozzles mounted in both sets of said vertically disposed holes.

11. The adhesive applicator head of claim 10 wherein the adhesive manifold comprises at least two chambers of decreasing diameters extending from each side laterally inwardly to the approximate center of the adhesive manifold where it meets the first inlet port for the liquid adhesive.

12. The adhesive applicator head of claim 11 wherein the two opposed pin holes are within about seven mils of each of the associated vertically drilled holes of the lower block.

13. The adhesive applicator head of claim 12 wherein each of the nozzles has a cylindrical-shaped body, a shoulder of lesser diameter at a lower base of the cylindrical-shaped body, and a still lesser-shaped nozzle tip with a truncated conical-shaped terminus extending from the shoulder.

14. The adhesive applicator head of claim 13 wherein the nozzle tip of each of the nozzles extends into the nozzle tip cavity sufficiently far that at least about 200 mils of the nozzle tip is contacted by air streams from the associated opposed pin holes.

* * * * *